US007344287B2

(12) United States Patent
DeBusscher

(10) Patent No.: US 7,344,287 B2
(45) Date of Patent: Mar. 18, 2008

(54) LAMP FORMED OF A GOLF BALL WASHER

(76) Inventor: Kenneth R. DeBusscher, 21312 Ardmore Park, St. Clair Shores, MI (US) 48081

( * ) Notice: Subject to any disclaimer, the term of this patent is extended or adjusted under 35 U.S.C. 154(b) by 175 days.

(21) Appl. No.: 11/222,520

(22) Filed: Sep. 9, 2005

(65) Prior Publication Data

US 2006/0056190 A1 Mar. 16, 2006

Related U.S. Application Data

(60) Provisional application No. 60/608,784, filed on Sep. 10, 2004.

(51) Int. Cl.
*H01K 1/18* (2006.01)

(52) U.S. Cl. ..... 362/414; 362/33; 362/413

(58) Field of Classification Search ..... 362/413, 362/253, 33, 410, 414; D21/789–796; 473/570, 473/573; 15/21.2, 104.92, 105, 160; *A36B 47/04*
See application file for complete search history.

(56) References Cited

U.S. PATENT DOCUMENTS

| | | | | |
|---|---|---|---|---|
| 3,748,676 | A * | 7/1973 | Warren et al. | 15/21.2 |
| 3,949,443 | A * | 4/1976 | Edgar | 15/21.2 |
| 4,274,129 | A * | 6/1981 | Stevens | 362/109 |
| 4,663,538 | A * | 5/1987 | Cotton et al. | 307/38 |
| 5,529,307 | A * | 6/1996 | Chang | 473/136 |
| 6,269,509 | B1 * | 8/2001 | Mays | 15/21.2 |
| 6,718,671 | B1 * | 4/2004 | Cluff | 40/611.03 |

* cited by examiner

*Primary Examiner*—Alan Cariaso
*Assistant Examiner*—Leah S. Lovell
(74) *Attorney, Agent, or Firm*—Gifford, Krass, Sprinkle, Anderson & Citkowski, P.C.

(57) ABSTRACT

A lamp includes a golf ball washer. The golf ball washer is mounted to a base. A frame extends outwardly from the golf ball washer. A light fixture is supported by the frame. A conduit extends through the golf ball washer so that an electrical wire can be routed between the base and the light fixture.

8 Claims, 4 Drawing Sheets

LAMP FORMED OF A GOLF BALL WASHER

CROSS REFERENCE TO RELATED APPLICATION

This application claims priority from U.S. Provisional Patent Application Ser. No. 60/608,784 filed on Sep. 10, 2004, the content of which is incorporated herein by reference in its entirety.

BACKGROUND OF THE INVENTION

1. Field of the Invention

The invention relates to household lamps. More particularly, the invention relates to a lamp formed of a golf ball washer.

2. Description of the Related Art

Ball washers for washing golf balls are frequently found on golf courses. Ball washers typically are mounted on a stand having a base. The washer unit includes a housing supporting an agitator assembly. The agitator assembly includes a container for water or washing solution. Brushes are mounted on an inner surface of the container. The agitator assembly also includes an elongated helical member having an aperture at one end to receive a golf ball. A knob is rotatably mounted to the other end of the helical member. The elongated member is manually raised and lowered into the container. As the helical member is raised and lowered, the helix rides against a guide surface to cause rotation of the agitator relative to the knob. The ball is held in the aperture and thus rotates with the agitator. The ball is spun across the brushes, thereby washing the ball. A conventional ball washer of this type is manufacture by Par Aide Products Co. of Lino Lakes, Minn.

Many golf enthusiasts decorate rooms in the, such as libraries and dens, with golf memorabilia. Accordingly, it remains desirable to provide a golf ball washer in the form of a lamp, suitable for use in libraries and dens of homes, and also for use in golf clubhouses.

SUMMARY OF THE INVENTION

According to one aspect of the invention, a lamp is provided that includes a base, a golf ball washer and a light fixture. The golf ball washer is mounted to the base. The light fixture is coupled to the golf ball washer.

According to another aspect of the invention, a lamp is provided that includes a base, a golf ball washer, a light fixture and a frame. The golf ball washer is mounted to the base. The frame supports the light fixture. The frame is pivotally coupled to the golf ball washer to allow selective position adjustment of the light fixture relative to the golf ball washer.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

The invention provides a household lamp that includes a base, a golf ball washer and a light fixture. Described below are several embodiment of the invention.

Figure 1:
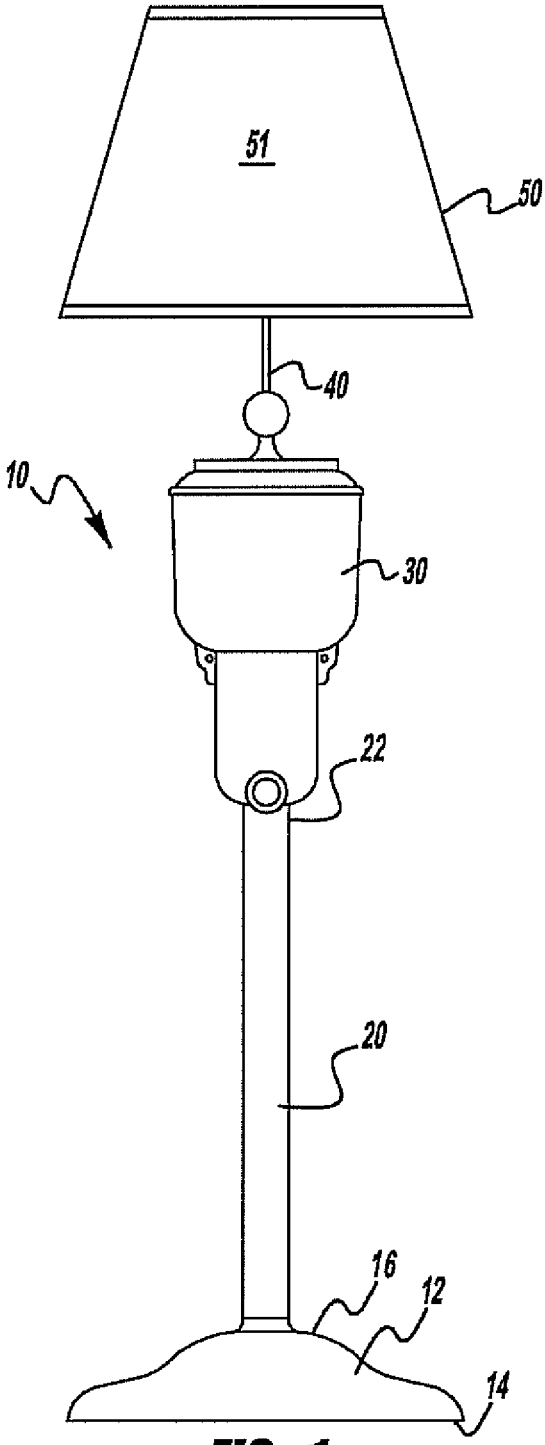
FIG. 1 is a front elevational view of a lamp according to one embodiment of the invention.
Figure 2:
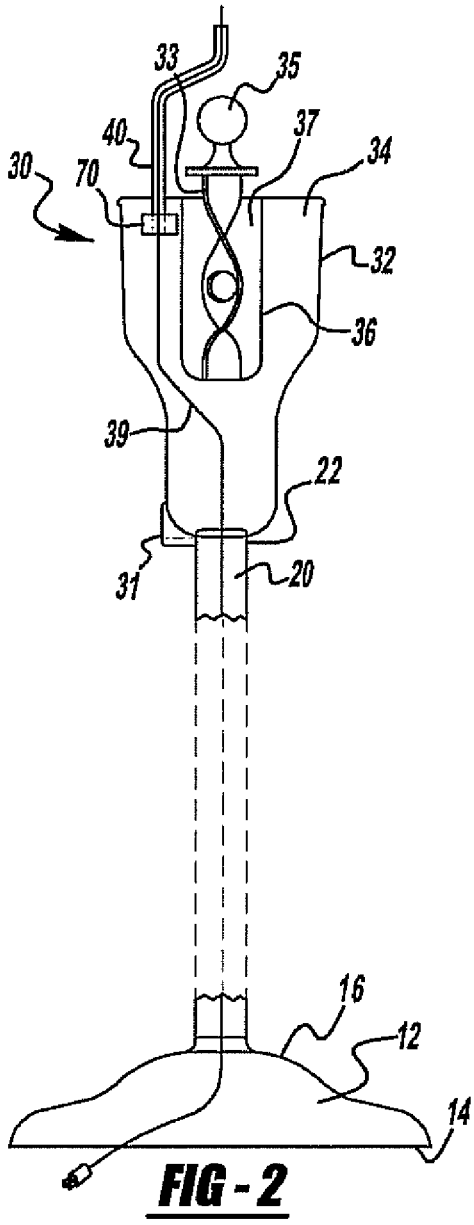
FIG. 2 is a side cutaway view of the lamp of FIG. 1.

In FIGS. 1 and 2, a first embodiment of the lamp is generally indicated 10. The lamp 10 includes a base 12, a stanchion 20, a golf ball washer 30 and a light fixture 50. The base 12 includes a flat bottom surface 14 and an opposite upper surface 16. The stanchion 20 extends upwardly from the upper surface 16 of the base 12. The golf ball washer 30 includes a housing 32 fixedly secured to a top end 22 of the stanchion 20. A generallly tubular frame 40 extends upwardly from the housing 32 for supporting the light fixture 50 and a lamp shade 51. A bracket 70 is fixedly secured to an inner surface of the housing 32. A bottom end of the frame 40 is then fixedly secured to the bracket 70. The frame 40 is bent so that the light fixture 50 is generally centered with respect to the housing 32.

Referring to FIG. 2, the housing 32 has a cavity 34. A drainage hole 31 is formed in the housing at the bottom of the cavity 34. A fluid container 36 is disposed within the cavity 34. The container 36 holds water or washing fluid. The container 36 includes a water fill 37 for pouring fluid into the cavity 34. An elongated member 33, or at least a portion thereof, is supported in the container 36. A handle or knob 35 is fixedly secured to an upper end of the elongated member 33. The elongated member 33 is slidably coupled to the container 36. The elongated member 33 is also guided by a helical surface so that the elongated member 33 rotates as it is raised and lowered into the container 36, thereby effecting the ball washing action.

A wire 39 providing electrical current to the light fixture 50 is routed through the frame 40 and through a bore in the bracket 70. The wire 39 continues from the bracket 70 into the cavity 34, but remains outside of the container 36. Optionally, a conduit (not shown) may be provided for concealing and protecting the wire 39 within the cavity 34 from liquids accidentally poured through a water fill 37 at the top of the ball washer 30. Alternatively, the water fill 37 is sealed to prevent any liquids from being placed in the ball washer 30. The wire 39 passes through a bore in the stanchion 20 and terminates at a standard household plug.

Figure 3:
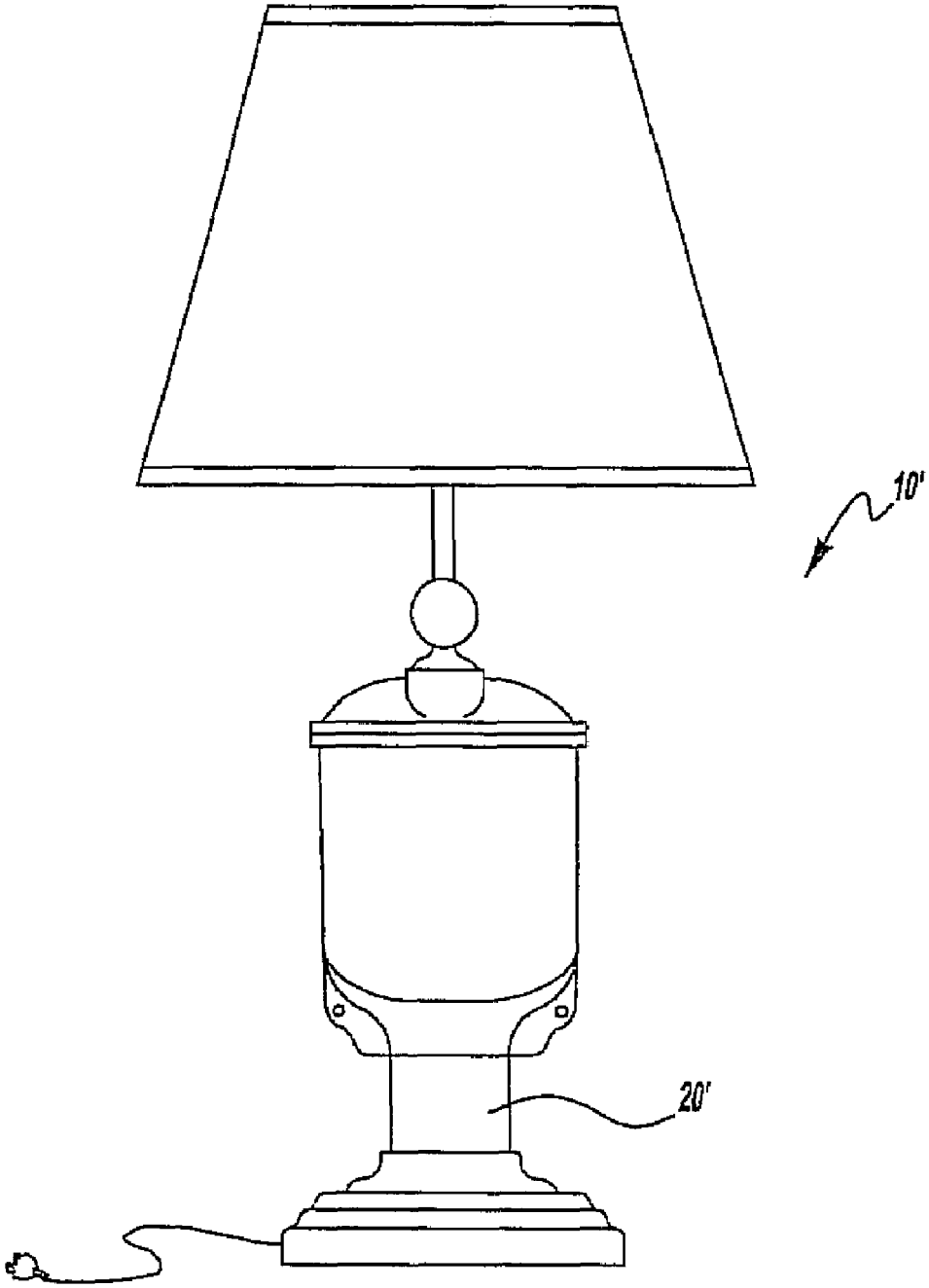
FIG. 3 is a front elevational view of the lamp according to a second embodiment of the invention.

In the embodiment of FIGS. 1 and 2, the stanchion 20 has a length allowing the lamp 10 to be used as a floor lamp with the base 12 placed on the floor. In FIG. 3, a second embodiment of the lamp 10' is shown, wherein the stanchion 20' is shortened for use of the lamp 10' on a table. It should, however, be readily appreciated by persons having ordinary skill in the art, any of the embodiments described herein can be produced as either floor or table lamps by providing a stanchion of appropriate length and shape.

It should be appreciated that the primary function of the lamp 10 is to illuminate its surroundings. As such, the golf ball washer portion of the lamp is not necessarily constructed to the same specifications as a dedicated golf ball washer as used on a golf course. For example, ball brushes that are normally found in the dedicated golf ball washer may be omitted from the golf ball washer 30 used with the lamp 10, or the brushes may be present only in the vicinity of the water fill 37 for aesthetic purposes and not along the length of the container 36. Thus, the golf ball washer 30 of the lamp 10 is constructed, in one embodiment, to simulate the look, feel and operation of the dedicated golf ball washers used on golf courses. Optionally, the elongated member 33 is locked in one position relative to the housing 32, so that the golf ball washer 30 maintains only the outward appearance of the dedicated golf ball washer. Optionally, a dedicated golf ball washer is adapted as described above to become part of the lamp 10.

Figure 5:
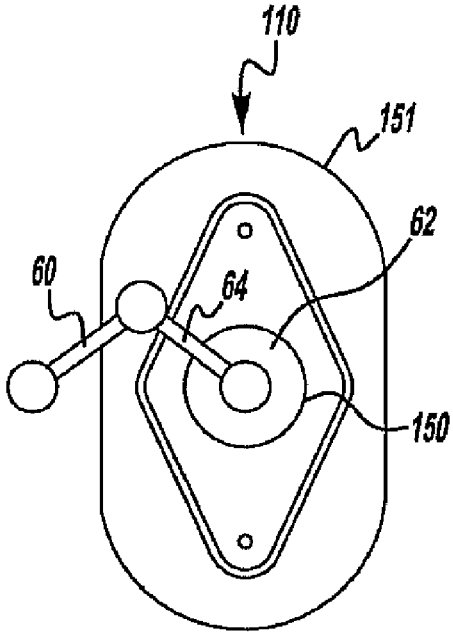
FIG. 5 is a front elevational view of the lamp according to the third embodiment.
Figure 4:
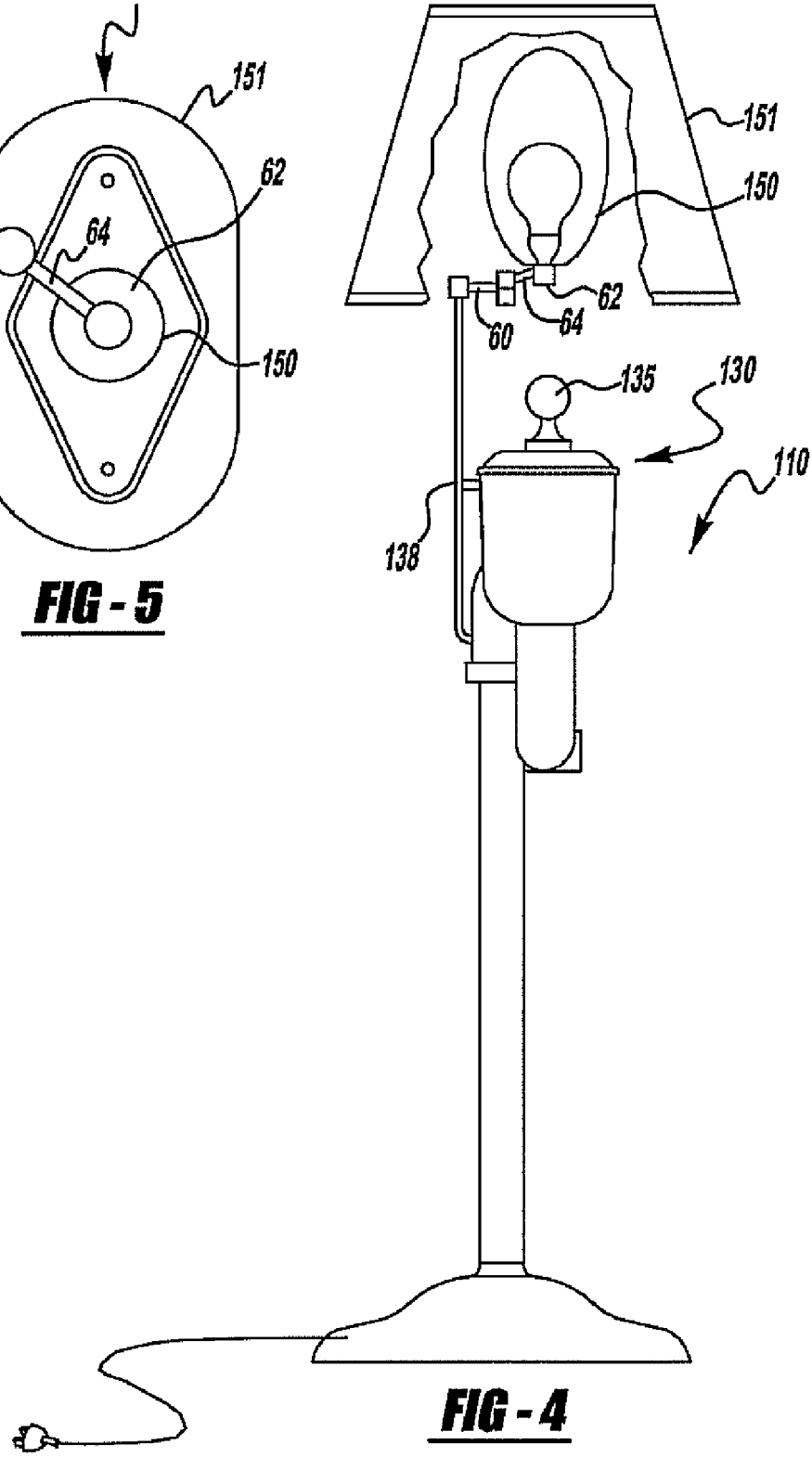
FIG. 4 is a top view of the lamp according to a third embodiment of the invention.

Referring to FIGS. 4-5, a third embodiment of the lamp is indicated at 110. In this embodiment, a radial arm 60 extends generally orthogonally from a top end of the frame 138. A base piece 62 supports the light fixture 150 and shade 151. A swing arm 64 is pivotally coupled between a distal end of the radial arm 60 and the base piece 62, so that the light fixture 150 and shade 151 may be pivoted away from the knob 135. By this arrangement, the ball washer 130 can be operated without interfering with the light fixture 150 and shade 151. Optionally, the radial arm 60 is pivotally coupled to the frame 138 to provide still greater range adjustment of the fixture 150 and shade 151 relative to the knob 135.

Figure 6:
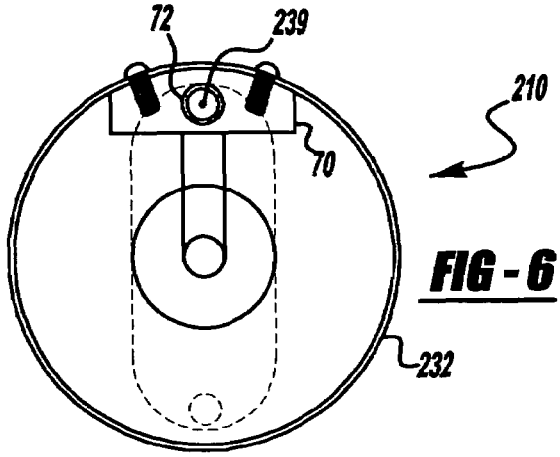
FIG. 6 is a top view of the lamp according to a fourth embodiment.
Figure 7:
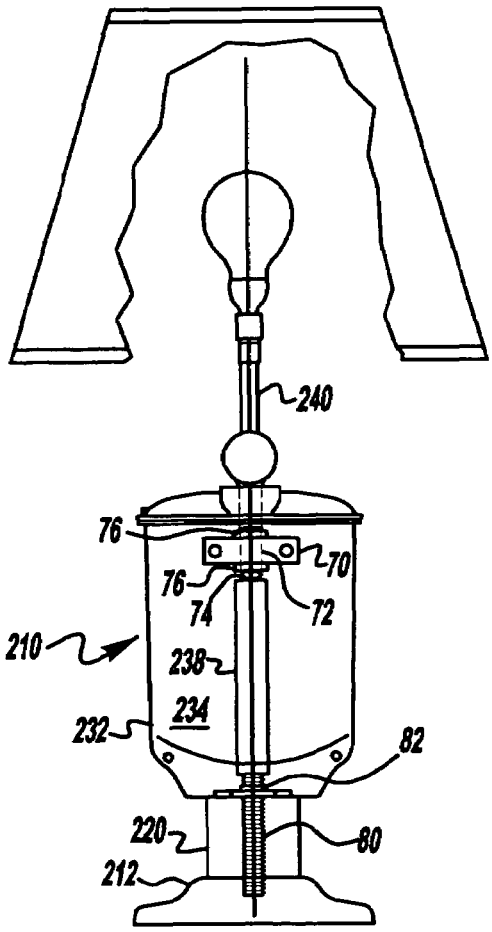
FIG. 7 is a front cutaway view of the lamp according to a fourth embodiment of the invention.

In FIGS. 6-7, a fourth embodiment of the lamp is indicated at 210, which includes a flexible conduit 238 that supports the wire 239 within the cavity 234. A metal block 70 is fixedly secured to the housing 232 along an inner surface of the cavity 234. The metal block 70 includes a threaded bore 72. A threaded upper pipe 74 is inserted through the bore 72. The pipe 74 is secured to the block 70 by nuts 76. A threaded lower pipe 80 extends through a bottom of the housing 232, the stanchion 220 and the base 212. Nuts 82 are secured to the ends of the lower pipe 80 to compressively hold the housing 232, stanchion 220 and the base 212 together.

Figure 8:
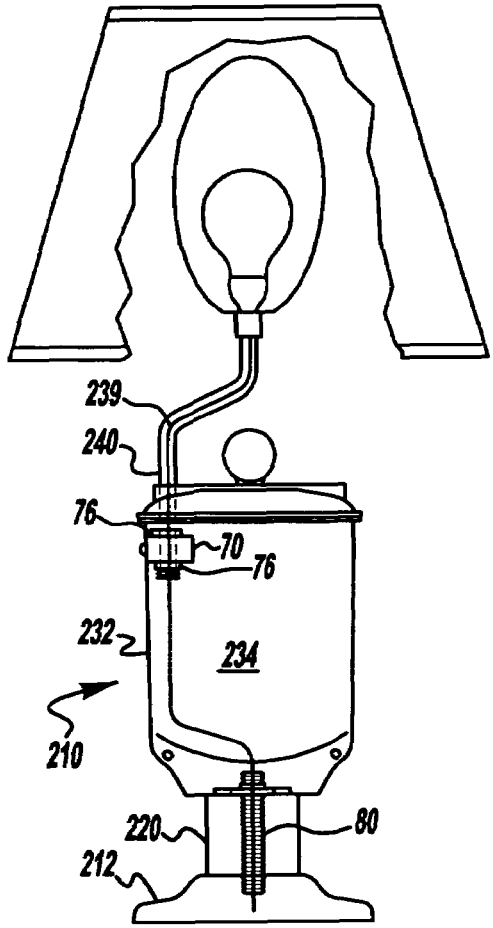
FIG. 8 is a side cutaway view of the lamp according to the fourth embodiment of the invention.

An upper end of the flexible conduit 238 is inserted around a bottom end of the upper pipe 74. A lower end of the flexible conduit 238 is inserted around a top end of the lower pipe 80. The frame 240 extends upwardly from the block 70 to support the light fixture 250. Thus, the wire 239 can be fed through the base 212, stanchion 220, the housing 232 via the flexible conduit 238 and the frame 240 to provide electrical current to the light fixture 250. As shown in FIG. 8, the lamp 210 may also be assembled without the conduit 238.

Accordingly, a novel lamp assembly is provided, which is formed from a conventional golf ball washer. The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

The invention claimed is:

1. A lamp comprising:

a base;

a golf ball washer mounted to said base;

a light fixture coupled to said golf ball washer;

a conduit extending from said base and through said golf ball washer; and a frame coupled to said conduit for supporting said lamp fixture above said base.

2. The lamp as set forth in claim 1 including a wire disposed within said conduit, said wire having one end extending through said base and an opposite end coupled to said light fixture for supplying electrical current to said light fixture.

3. The lamp as set forth in claim 1, wherein said frame is movably coupled to said conduit to allow selective position adjustment of said light fixture relative to said golf ball washer.

4. The lamp as set forth in claim 2, wherein said conduit is sealed to prevent liquid from contacting said wire.

5. A lamp comprising:

a base;

a golf ball washer mounted to said base;

a light fixture coupled to said golf ball washer; and a conduit extending from said base along an outer surface of said golf ball washer.

6. The lamp as set forth in claim 5 including a wire disposed within said conduit, said wire having one end extending through said base and an opposite end coupled to said light fixture for supplying electrical current to said light fixture.

7. The lamp as set forth in claim 6 including a frame for supporting said light fixture, said frame being pivotally coupled to an upper end of said conduit to allow selective position adjustment of said light fixture relative to said golf ball washer.

8. A lamp comprising:

a base;

a golf ball washer mounted to said base;

a light fixture; and a frame for supporting the light fixture, said frame being pivotally coupled to the golf ball washer to allow selective position adjustment of the light fixture relative to the golf ball washer.

* * * * *